US006952881B2

(12) United States Patent
McGivern

(10) Patent No.: US 6,952,881 B2
(45) Date of Patent: Oct. 11, 2005

(54) PROGRAMMABLE SIGHTING SYSTEM FOR A HUNTING BOW

(75) Inventor: Joseph F. McGivern, 430 Timberwood Trail, Ortonville, MI (US) 48462

(73) Assignee: Joseph F. McGivern, Ortonville, MI (US)

( * ) Notice: Subject to any disclaimer, the term of this patent is extended or adjusted under 35 U.S.C. 154(b) by 0 days.

(21) Appl. No.: 10/309,397

(22) Filed: Dec. 2, 2002

(65) Prior Publication Data

US 2003/0101604 A1 Jun. 5, 2003

Related U.S. Application Data

(60) Provisional application No. 60/336,617, filed on Dec. 4, 2001.

(51) Int. Cl.[7] ..... G41G 1/467
(52) U.S. Cl. ..... 33/265; 124/87
(58) Field of Search ..... 33/265, 293; 124/87

(56) References Cited

U.S. PATENT DOCUMENTS 3,475,820 A * 11/1969 Kernan ..... 33/265
3,696,517 A * 10/1972 Larson ..... 33/265
4,617,741 A * 10/1986 Bordeaux et al. ..... 33/265
4,979,309 A 12/1990 Oligschlaeger ..... 33/265
5,575,072 A 11/1996 Eldridge ..... 33/265
5,634,278 A 6/1997 London ..... 33/265
5,836,294 A * 11/1998 Merritt ..... 33/265
5,914,775 A * 6/1999 Hargrove et al. ..... 33/265
6,073,352 A 6/2000 Zykan et al. ..... 33/265
6,191,574 B1 * 2/2001 Dilger ..... 33/265

* cited by examiner

*Primary Examiner*—Christopher W. Fulton
(74) *Attorney, Agent, or Firm*—Amin & Turocy, LLP; Eric D. Jorgenson

(57) ABSTRACT

A programmable sighting system for a hunting bow or professional archery bow. The system comprises a housing assembly for mounting the sighting system on the bow. A transparent window is positioned in the housing for viewing therethrough by a user to a target, and for projecting display data thereon. A programmable subsystem is contained within the housing assembly for causing display of the display data at selected locations on the window in response to control by the user.

39 Claims, 8 Drawing Sheets

On-Demand Range Estimator

"Hunt Mode" Sight Artifacts

PROGRAMMABLE SIGHTING SYSTEM FOR A HUNTING BOW

BACKGROUND OF THE INVENTION

This application claims priority from U.S. Provisional application Ser. No. 60/336,617 filed Dec. 4, 2001, and entitled "Programmable Sighting System For A Hunting Bow".

This invention is related to a hunting bow sighting system, and more particularly to a programmable sighting system that mounts on a hunting bow.

There are a large number and variety of bow sights available on the market, all designed with the primary purpose of enabling a user to more accurately deliver an arrow to a target. One important parameter that needs to be determined before successfully reaching the target is the distance from the user to the target. Additionally, when encountering moving targets, the speed and direction of the moving target also enters into the equation.

What is needed is a programmable sighting system that presents a heads-up-display through which a hunter or a professional target shooter can view and ascertain a target.

SUMMARY OF THE INVENTION

The present invention disclosed and claimed herein, in one aspect thereof, comprises a programmable sighting system for a hunting bow. The system comprises a housing assembly for mounting the sighting system on the bow. A transparent window is positioned in the housing for viewing therethrough by a user to a target, and for projecting display data thereon. A programmable subsystem is contained within the housing assembly for causing display of the display data at selected locations on the window in response to control by the user.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE INVENTION

The disclosed sighting system provides a programmable feature for automatically displaying graticules for locating a target.

Figure 1:
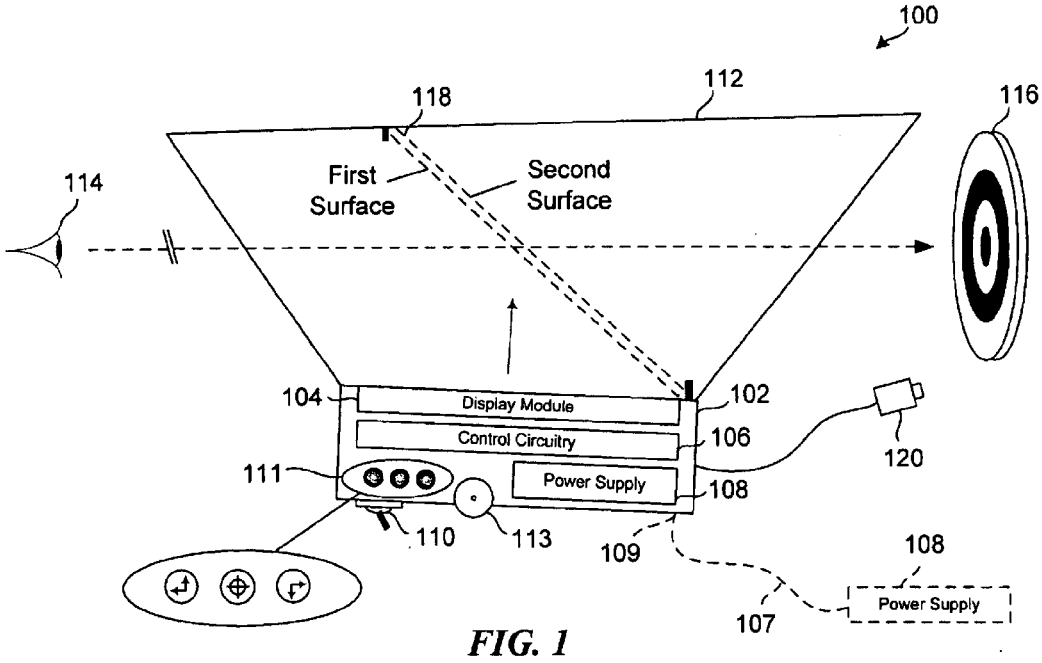
FIG. 1 illustrates a side view of a user viewing a target through the sighting system, according to a disclosed embodiment.

Referring now to FIG. 1, there is illustrated a side view of a user viewing a target through the sighting system 100, according to a disclosed embodiment. The sighting system 100 includes an electronics assembly module 102 for housing the electronics and power source for the sighting system 100. The module 102 is preferably a NEMA-rated (National Electrical Manufacturers Association) enclosure to prevent condensation or other harmful materials from entering the circuitry and damaging the electronics. However, the module 102 need not be NEMA-rated, but can be any enclosure (or housing) suitably manufactured to prevent ingress of dust, moisture, or the like. The housing of the module 102 is sufficiently rugged to protect the internal electronics and mechanical parts from being damaged if dropped during the hunt (e.g., from an elevated blind) or submerged in liquids, such as dropping the bow and sighting system into water.

The module 102 includes a display module 104 for displaying information corresponding to programmed instructions stored in control circuitry 106 operatively connected to the display module 104. For example, a type of display suitable for such a low-power application is a negative transmissive LCD (liquid crystal display). A negative transmissive unit displays a negative image, and is backlit for best readability. The negative transmissive LCD offers a different appearance than typical LCDs, bringing a light-emitting look to the displayed product.

The LCD display can be of varying resolution to enhance the resolutions of the sighting artifacts. That is, depending on the resolution of the display module 104, the graticule lines can be placed in close proximity to one another whereas in conventional mechanical system are limited by the mechanical parts and assembly configuration. A power supply 108 is preferably positioned in the module 102 to provide power to all onboard electronics. However, to maintain a minimum size of the module 102, the power supply 108 can be externally mounted to, e.g., the bow or bow mounting assembly such that power is provided to the module 102 via a cable 107 that connects to a power port 109. The power supply 108 is, for example, a 9-volt battery that can be inserted into a compartment of the electronics module 102 via a rear hatch. Note that other power sources can also be utilized so long as the source is compatible with the power requirements of the display module 104, control circuitry 106, and other power-consuming components.

A power switch 110 allows the user to turn the system 100 off and on. A thumbwheel switch 113 allows the user to adjust the light intensity of the display 104 by simply rotating the switch either direction to increase or decrease the display intensity. Thus for daylight hunting or target shooting, the user can increase the display intensity for easier viewing, while a night, the intensity can be decreased according to the user's viewing preferences. There are provided three setup and configuration switches 111 for programming the system 100 according to the user preferences. The switches 111 function to allow the user to navigate through a setup and configuration program stored in the system 100, and to make selections provided therein. A first of the three switches 111 allows the user to navigate down and to the right, a second switch of the three switches 111 allows the use to navigate up and to the left, and the last switch of the three switches 111 allows the user to select a program option. It is appreciated that one or more light sources (e.g., light emitting diodes (LEDs)) can be provided in the housing of the module 102 to serve as status indicators to a viewer 114. The indicators would then correspond to programmable selections made by the viewer 114, and other indications, for example, power is on, the system is performing a self test, etc. However, it is preferable to not provide such light indicators such that the target animal can see them. Thus the light indicators are situated to the rear of the module 102, or not utilized in the system at all. Preferably the control circuitry 106 processes system status signals that can be presented to the user via a heads-up display (HUD) projected onto a viewing window 118.

The viewing window 118 is not restricted to the size of the LCD display of the display module 104 in that a larger or smaller window 118 can be utilized by providing corresponding amplification or reduction of the projected HUD on the viewing window 118.

As indicated hereinabove, the sighting system 100 includes one or more buttons or controls for adjustment of the display brightness, powering the unit off/on during times of inactivity, enabling a power-saving feature whereby the unit is placed in a standby/sleep mode for a predetermined amount of time (until the user wakes up the system 100 via the remote switch 120 as a fail safe) or as the design intends, and for configuration, setup, and testing of the sighting system 100. There is also provided a momentary switch 120 wired remotely such that the user can easily depress the switch 120 from a convenient location (e.g., on the bow frame, or on a hand, arm, or other location on the user) for exercising various program selection functions discussed in greater detail hereinbelow. In particular, the switch 120 can be used to enter a range estimator mode for determining the distance to the target.

Although not required, a leveling mechanism (not shown) can also be provided such that the viewer 114 can orient the bow before releasing an arrow to the target 116. The leveling mechanism can be a 2-D or 3-D level sensor. Preferably, the 3-D sensor operatively connects to the control circuitry 106 to provide signals in accordance with the backward and forward tilt position of the bow, and also the yaw (or sideways tilt) of the bow. In response to meeting preprogrammed criteria for 3-D tilt, the control circuitry 106 will present via the display module 104 an indicator (e.g., a green colored indication) indicating that the bow positioning meets the criteria for releasing the arrow to the target. When the tilt criteria are not met, the indication can be, e.g., a red indication. Another benefit of providing the computerized sight system 100 is that no matter what the 3-D tilt position of the bow, the orientation of the visual data presented by the display module 104 on the HUD can be automatically skewed in relation to the bow position. For example, if the user prefers to tilt the bow at ten degrees to the left, and to point the arrow ten degrees up, based upon the tension utilized during release to reach the target, the system can be programmed accordingly to present a green indication on the HUD when the matching bow orientation occurs according to the signals provided by the 3-D sensor. At this point, and provided the user's head is oriented in a straight upward position, the user will be looking at the display, which is also tilted ten degrees to the left. In order to provide a more readable view, the system 100 can be programmed to automatically compensate for the skewed data presentation by displaying the data in a true vertical manner on the display 104. Thus the bow will be tilted ten degrees during the shot, yet the displayed data on the HUD is presented vertically. It is appreciated that such a system can compensate the HUD data such that the system 100 can be utilized on a crossbow. Alternatively, of course, the system 100 can be mounted on the crossbow such that the display is substantially vertical for normal use when the crossbow normally oriented horizontally. The leveling mechanism can also be a simple bubble type indicator for positioning the bow accordingly. The display module 104 can also be programmed to provide a displayed skew of selected artifacts (or graticules) to the viewer 114 during the aiming process.

Attached to the electronics module 102 is a viewing housing 112 through which the viewer 114 views a target 116. Positioned within the viewing housing 112 is a transparent viewing window 118. The viewing window 118 is preferably a beam splitter with an optimized R/T (reflectance/transmittance) ratio on the first surface facing the viewer 114, and anti-reflection (AR) coating on the second surface (surface furthest from the viewer 114) to sufficiently attenuate the secondary reflection of the sighting artifacts off the second surface. The AR coating will appear transparent to the viewer 114, and simply absorbs lightwaves of various selected frequencies, or in the case of a broadband AR, a spectrum of light frequencies.

The viewing housing 112 is made of an opaque material that is sufficiently rugged to withstand use in rugged outdoors environments (e.g., plastics or light metals), and to maintain the viewing window 118 within the viewing housing 112.

Additionally, the sighting system 100 is not limited to rugged outdoor applications, but is also operable for use in target shooting in a professional competition application. In such an application, the sighting system 100 can be fabricated from a low mass material. The viewing window 118 snaps or slips into a slot of the housing 112 such that if damaged, the replacement process is quick and easy to accomplish.

The viewing window 118 is positioned at an angle that allows the display module 104 to project the HUD onto the reflective viewing window 118 for convenient viewing by the viewer 114. The display module 104 is illustrated as being mounted along the top of the electronics module 102, however it can be mounted along the top, side, or in an orientation whereby projection of the programmed images of the display module 104 to the viewing window 118 is determined to be optimum.

The viewing housing 112 is a unique rectangular conical shape such that it minimizes intrusion of the housing 112 during the sighting process to the target 116 and reduces the potential of rain or debris from interfering with the sighting process. The hunter viewer 114 sees only a thin wall of the housing 112 when viewing the target 116 through the viewing window 118. Note that the shape of the housing 112 is not limited to the disclosed conical shape, but may be any shape, for example, circular or elliptical such that it provides sufficient support for the viewing window 118, and minimizes intrusion of the housing 112 into the sighting process of the viewer 114 during the targeting process. Additionally, the shape of the housing 112 minimizes ambient light pollution from entering the sighting system 100 which would cause a reduced viewing capability of seeing the HUD and viewing the target through the viewing window 118.

The disclosed sighting system 100 provides, but is not limited to, the following: minimizes sight enclosure obstruction; multiple high-resolution sights; independent sight adjustment and position, both horizontally and vertically; multiple graticules for different types of animals (or only the animal name for a less obtrusive view), and displays the animal (or only the animal name) or target when range estimating; a single point artifact and specific target; minimizes water intrusion; a graticule target range estimator; displays sight distances; offers automatic calculation and display of sights in the desired dimensions (e.g., feet, meters, yards, etc.); and stores sight data. Further, utilizing the described display system, the light is reflected back to the viewer 114 such that a target animal will not see light emitted from the sighting system 100. In contrast, some conventional sighting systems provide sighting light sources that can be seen by the target animal.

Figure 2:
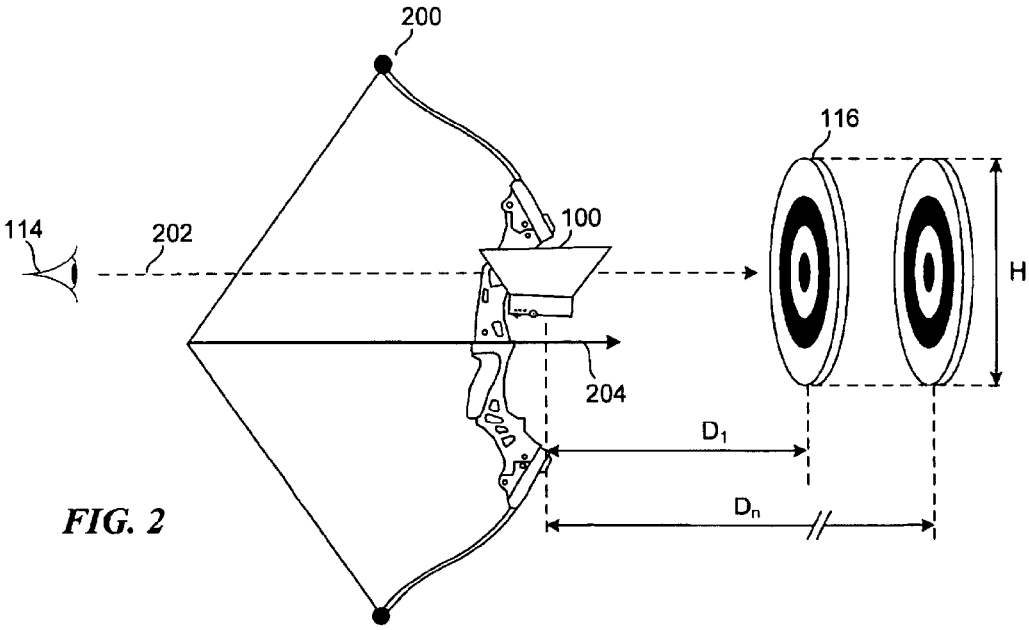
FIG. 2 illustrates a side view of a user viewing the target through the sighting system mounted on a bow, according to a disclosed embodiment.

Referring now to FIG. 2, there is illustrated side view of a user viewing the target through the sighting system mounted on a bow, according to a disclosed embodiment. The sighting system 100 is suitably mounted on a bow 200 such that the viewer 114 sights through the viewing window 118 of the sighting system 100 along a line-of-sight (LOS) 202 to the target 116. The viewer 114 configures the sighting system 100 (i.e., "sights in") to one or more fixed distances $D_1 \ldots D_n$ to the target 116 having a fixed height dimension H. During a hunting excursion, a live target approximating the size of the target 116 having a target height H fixated at a distance within one of the configured distances $D_1 \ldots D_n$ of the sighting system 100 can be quickly ascertained and targeted with an arrow 204. Programming and mounting of the sighting system 100 compensates for arc of the arrow 204 during travel to the target 116.

Figure 3:
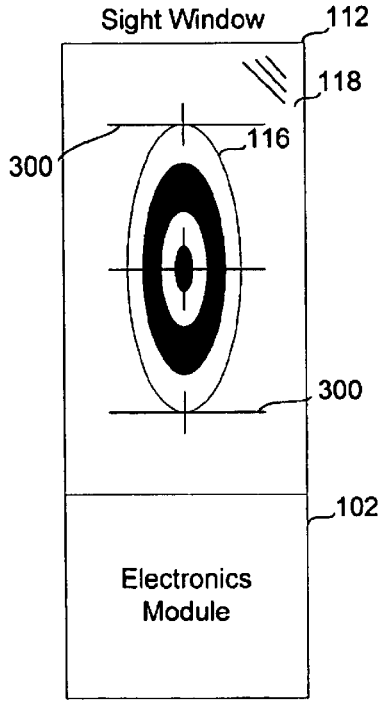
FIG. 3 illustrates a forward view from the perspective of a user while sighting through the display to a target.

Referring now to FIG. 3, there is illustrated a forward view from the perspective of the viewer 114 while sighting through the HUD display projected onto the viewing window 118 to the target 116. The control circuitry 106 within the electronics module 102 is programmed to project one or more HUD graticules lines 300 containing either horizontal or vertical bars, graphic artifacts, or any combination thereof, onto the reflective window 118. Note that the disclosed display module 104 is not limited to forming bars or straight-line projections, but may also include graphic objects having projections of any shape or orientation limited only by the programming capabilities and power requirements of the internal control circuitry 106. For example, it can be appreciated that a hunter may prefer HUD graticules lines 300 comprising arcs or a combination of bulls-eye sights, or any other graphic artifacts such that the control circuitry 106 can be programmed by the hunter to cause display of such artifacts on the graticules lines 300 for projection onto the reflective window 118. The HUD artifacts 300 aid the hunter in viewing the target 116 through the viewing window 118, and to calibrate the one or more distances $D_1 \ldots D_n$ to the target 116 based upon the position of the target 116 relative to the graticule lines 300. The graticule lines 300 can also be displayed in a variety of colors in accordance with selections programmed into the internal control circuitry 106. However, the particular colors and types of graticule lines 300 and artifacts utilized can be provided in accordance with various lighting conditions such that a certain color combination is preferable at a certain time of day, as may be certain types or combination of sighting artifacts. The control circuit 106 also provides the capability of displaying alphanumeric text to the viewer 114. Additionally, various types of colored alerts and indicators can be displayed to the viewer 114 according to program instructions, and in response to signals provided by the components and subsystems.

Figure 4:
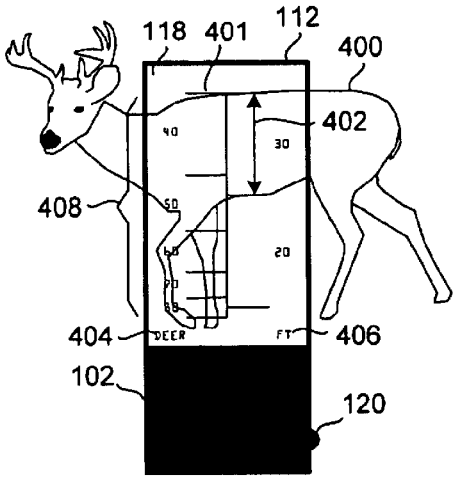
FIG. 4 illustrates a view of an on-demand range finder displayed to a user while looking through the sighting system at a target.

Referring now to FIG. 4, there is illustrated a view of an on-demand range estimator displayed to the viewer 114 while looking through the sighting system 100 at a target 400. In operation, a range-estimator graticule 401 is displayed on the viewing window 118 such that the viewer-hunter 114 can quickly ascertain the distance to the target animal 400, if desired. Such a method is based upon the back-to-belly (B2B) distance of the target animal 400 at the desired location. For example, if an average male deer if a weight of 200 lbs. has a B2B distance B at the chest portion, this distance B is used to approximate the distance $D_n$ from the viewer 114 to the target animal 400. The HUD graticule system 401 displayed to the viewer 114 is capable of providing the type text 404 of the target animal 401, the distance dimension 406 in which the distance to the target is measured (e.g., feet), and a gradient of graticule lines 408 of distances for matching up the B2B distance of the target animal 400. The thumbwheel switch 120 mounted on the electronics module 102 allows the viewer 114 to quickly and easily set the light intensity of the HUD graticule system 401 to be displayed. As indicated hereinabove, the graticule 401 can be presented as a single color, or in multiple colors.

Including the programmable LCD display offers a wide variety of adjustments in the displayed output. The graticules 401 can be programmed for display on the viewing window 118 left or right of an imaginary vertical center line of the viewing window 118, and above and/or below an imaginary horizontal center line of the viewing window 118. Artifacts placed on a graticule line can be adjusted individually on that line off from center, as described in FIG. 5 hereinbelow.

The system 100 is operable to automatically calculate and display other graticule lines 300 once a first graticule line is determined.

Figure 5:
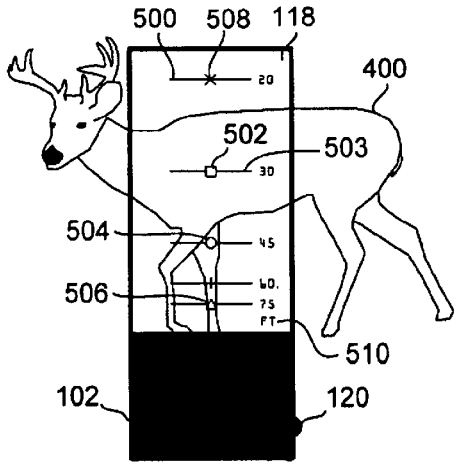
FIG. 5 illustrates a view of a graticule and associated artifacts displayed to a user while looking through the sighting system at a target.

Referring now to FIG. 5, there is illustrated a view of a graticule and associated artifacts displayed to a viewer 114 while in a "Hunt Mode" and looking through the sighting system 100 at the target 400. As soon as the viewer 114 determines an approximate distance to the target animal 400, a "Hunt Mode" graticule 500 can be displayed. In this particular example, the B2B distance in "Range-Estimator" mode of FIG. 4 indicates that the distance to target animal 400 corresponds to 30 feet. Thus the "Hunt Mode" graticule 500 displays a square artifact 502 on a graticule line 503 that corresponds to the 30-foot distance to the target 400. Note that the sighting system 100 is operable to display a number of different artifacts on each graticule line 503, and across other graticule lines, each of which may have a different color and shape. Other artifact designs can be programmed for displayed, as well. As illustrated in FIG. 5, a circle 504, triangle 506, and "X" 508 artifacts are just examples of the flexibility offered by the display and programming capabilities of the disclosed sighting system 100. The artifact 502 can also be programmed to blink such that the hunter viewer 114 is not momentarily confused as to which of several artifacts to place on the target 400, but can quickly place the appropriate artifact 502 on the target 400. The "Hunt Mode" HUD graticule 500 also includes a dimension indicator 510. Although not shown, a low-battery indicator can be provided on the HUD for indicating to the hunter the status of the power supply 108.

The graticule 500 can be programmed to skew according to the lean of the hunter. By providing an automatic leveler within the sighting system 100, the orientation of the bow 200 is measurable such that the graticule 500 can be skewed accordingly to counter the direction of lean, and maintain a substantially vertical graticule 500 on the target 400. The module 102 also includes the intensity adjustment thumbwheel 120.

Figure 6:
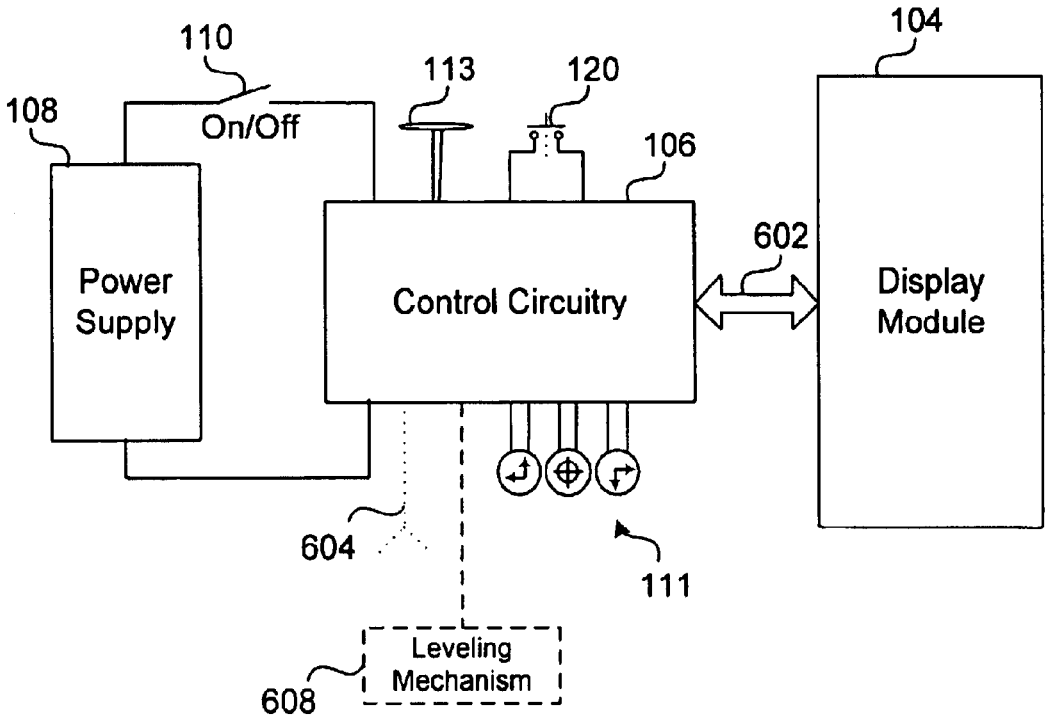
FIG. 6 illustrates a general circuit block diagram of the sighting system.

Referring now to FIG. 6, there is illustrated a general circuit block diagram of the sighting system 100. The control circuitry 106 provides the intensity adjustment thumbwheel 113 whereby the hunter can adjust the brightness of the sighting and distancing graticule. The lighting adjustment 113 is preferable to counter detrimental effects of natural lighting conditions that can be experienced when hunting in a variety of geographical areas, seasons, and other hunting conditions. Contrary to some conventional systems, the disclosed sighting system 100 operates to illuminate the sight mechanism, and not the target.

The control circuitry 106 is operable be programmed according to the navigation and selection switches 111. Additionally, the switch 120 provides for quick toggling between HUD graticules programmed to be available in a toggle mode. The switch 120 can be configured as a remote finger switch on a wired extension allowing the archer to toggle between sights and the range finder without having to substantially move one or both hands to toggle the displays when in a sighting or firing pose. Such graticules include those programmed for a variety of targets. As mentioned hereinabove, such HUDs include the "Hunt Mode" and "Range-Estimator" mode displays and corresponding programmed graticules. It is appreciated that programming can be implemented according to any combination of the switches (111 and 120). For example, program instructions can be provided that execute when two of the three switches 111 are depressed. Similarly, program instructions can be provided such that depressing the switch 120 and one of the three switches 111 causes associated instructions to provide a specific output. Still further, as an example, rotating the thumbwheel 113 while depressing one of the three switches 111 could be programmed to allow the user to quickly scroll through the setup and configuration program.

The control circuitry 106 interfaces to the display module 104 via a bus 602. The bus 602 can be conventional communication bus architecture, for example, $I^2C$. Optionally, the control circuitry 106 includes a wired and/or wireless communication input/output interface 604 such that the control circuitry 106 can be programmed from an external source, or download stored programming to the external source. Preferably, the sighting system 100 comes preprogrammed such that no further programming is required from an external source. That is, the typical B2B settings for a variety of the more commonly hunted animal targets at average distances are preprogrammed into the system 100.

Power to the onboard electronics is provided by the power supply 108. In this embodiment, power to the display module 104 is carried through the bus 602 from the control circuitry 106. The power switch 110 provides on/off capability to the user when the sighting system 100 is not in use. As indicated hereinabove, the control circuitry 106 is operable to provide a power-save feature such that inactivity over a predetermined period of time automatically drops power to selected onboard electronics or substantially reduces the power provided thereto such that the system can be quickly brought back into a full power state. The power save feature can also be invoked manually by pressing a button for a fixed period of time. Pressing a button, sensing input from a leveler sensor, etc., can then enable full-power operation.

A leveling mechanism sensor 608 provides input to the control circuitry 106 relevant to the lateral tilt (i.e., left-right) and preferably, the forward tilt of the bow 200. In response thereto, the HUD can be programmed to be displayed in a skewed fashion such that the HUD appears vertical on the target while the hunter leans to fire.

The control circuitry 106 is microprocessor-based, and operational in both a manual mode and an automatic mode. In manual mode, the user utilizes one or more mechanical adjustment buttons or knobs to position one or more sighting artifacts onto the sighting window, and then sighting in that particular artifact. The user can than make another manual selection to enter the distance associated with a particular sight or artifact. The circuitry contains a non-volatile memory (e.g., an EEPROM, flash memory, etc.) for storing settings made by the user. Preferably, the type of memory used is a low power memory that minimizes the power drawn from the power source. Thus any loss of power precludes loss of the settings stored in the memory during battery replacement or any other scenario causing loss of power to the circuitry. Once all of the sight configurations have been set manually and stored into memory, of which there can be many different configurations, the user need only simply select the configuration based upon the distance from the target, the type of target, and in accordance with any other conditions that affect sighting the particular target.

Another advantage of the disclosed sighting system 100 is that the sight artifacts can be placed very close together on the viewing window 118 offering high resolution targeting, whereas conventional mechanical systems preclude sight placements in close proximity of one another resulting in lower resolution targeting. Additionally, conventional systems do not provide for placement of distance markings next to the sight artifacts.

The microprocessor executes the stored program that is operable to provide a menuing system that allows the user to enter an initial distance and subsequent distances corresponding to the location of the projected sighting artifacts on the window. In automatic mode, the user sights to a single distance, and the microprocessor automatically interpolates or back calculates to a spread of additional sights and corresponding distances according to preselected parameters (e.g., every ten feet, or every ten meters). The system can be user-selectable to accommodate different dimensions, such as feet, yards, meters, etc. The sighting artifact is also adjustable in height and width according to user preferences.

The sighting system 100 can also be mounted a short distance from the bow 200 by utilizing an extendable mounting apparatus. The user than configures the sighting system 100 accordingly such that artifacts may be made larger for easier viewing when the user eye is, for example, 2–3 feet from the sighting assembly.

The sighting system 100 is mechanically operable such that the viewing housing 112 is spring loaded and can be pulled outward and rotated downward or upward for storing in a storage housing or column, or even completely removed and stored, so that the sighting system will not interfere with any conventional hard case during storage. This feature also facilitates non-use of the sighting system during a hunting or professional target shooting episode such that the bare bow is utilized without the sighting system 100. A quick-release mechanism can be provided such that the sighting system 100 is easily removed from the bow 200, or from whatever hunting device it is mounted.

The sighting system 100 is compatible with a fully 3-dimensional mechanical mounting apparatus for mounting on a bow and mechanically operable for use on either side of the bow 200 for use by left-handed and right-handed hunters. The mounting bracket apparatus also allows the user to position the sighting system 100 a short distance laterally from the bow 200 in accordance with user sighting preferences. Additionally, the projected artifacts can be adjusted laterally (or horizontally) on the display module 104 such that the user can set the artifact position in accordance with user preferences to improve the chances of the user hitting the target 116.

Figure 7:
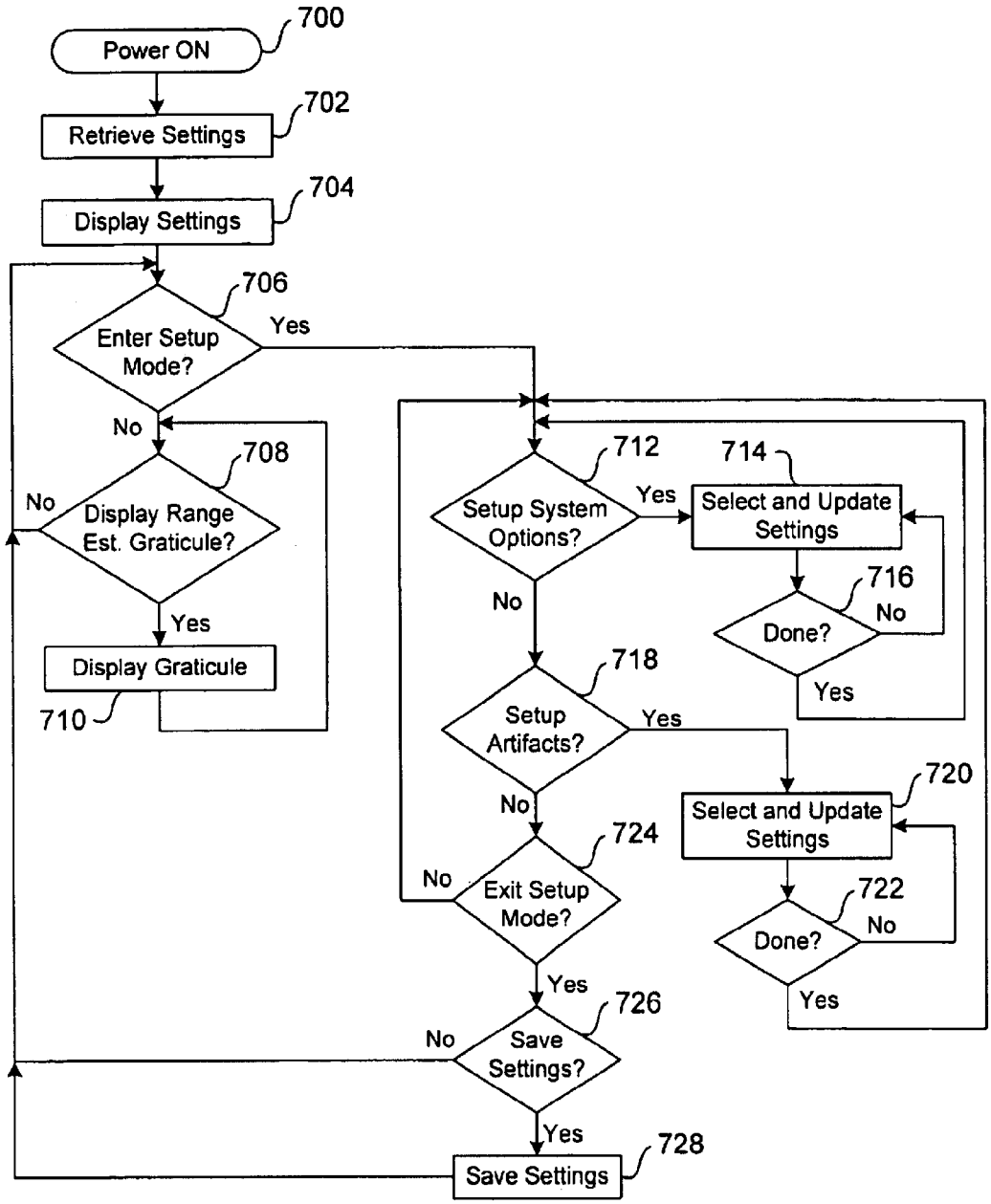
FIG. 7 illustrates a flow chart for operating and programming the sighting unit.

Referring now to FIG. 7, there is illustrated a basic flow chart for operating and programming the sighting system 100. Flow begins at 700 where the user turns power on. At 702, the current settings are then retrieved. The settings are displayed on the HUD, at 704. The user can then choose to enter setup mode at 706. If not, at 708 the user can choose to display the range estimator graticule. If the user chooses not to display the range estimator graticule, flow is back to the input of 706. If the user chooses to display the graticule, flow is to 710 where the graticule is displayed. Flow then loops back to the input of 708.

If the user chooses to enter setup mode, flow is from 706 to 712 to determine whether to setup the system options. If so, flow is to 714 to select and update the settings. Flow is then to 716 to determine whether the process is completed. If not, flow is back to 714 to continue the process until completed. If the process is completed, flow is back to the input of 712 to again determine if system options arc to be setup. If not, flow is to 718 to determine whether to setup artifacts. If so, flow is to 720 to select and update artifact settings. If not done, at 722, flow is back to 720 to continue the process. If done, flow is back to the input of 712 to determine if any other setup processes are to be performed. If neither system nor artifact setup is to be performed, flow is through 712 and 718 to 724, to determine if the settings are to be saved. If not, flow is back to the input of 706 to enter setup mode, and perform the desired setup. If the settings are to be saved, flow is from 726 to 728 to save the settings in the memory. Flow then loops back to the input of 706.

Note that the flow chart is only an example of the some of processes that can be provided in programming associated with the disclosed sighting system 100. Moreover, the various options and selections provided in the flowchart are not exhaustive or limited to those illustrated, but can include further options and selections limited only by the available control circuitry 106, and can be performed at different points in the process.

In more robust implementations, the disclosed sighting system 100 includes a camera and recording system contained therein sufficient to record and playback pictures of what the viewer perceives through the viewing window 118. In such an implementation, the sighting system 100 includes a mass storage device, for example, a micro-disk magnetic storage unit for recording and playback of images via the viewing window 118. The stored images include the sighting artifacts laid on top of the image, as the viewer 114 perceives the target through the viewing window 118. Alternatively, the images stored on the micro-disk are downloaded via a USB (Universal Serial Bus) or IEEE 1394 high-speed connection provided on the sighting system 100. Such an application requires a correspondingly robust power source 108 to power the additional hardware enhancements in support of such functionality.

Figure 8:
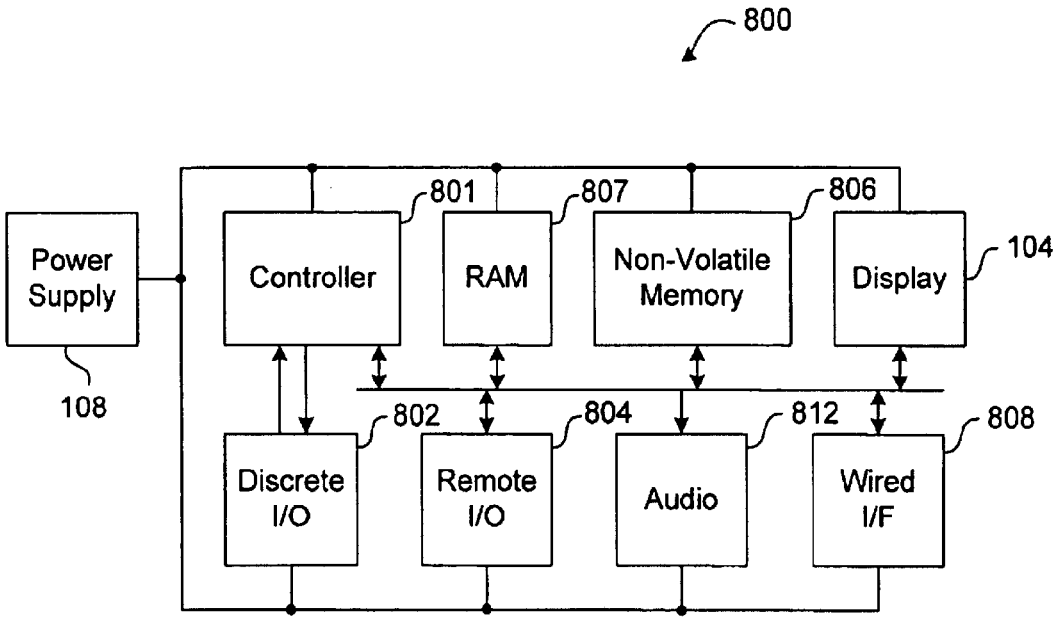
FIG. 8 illustrates a more detailed block diagram of a system of the embodiment of FIG. 6 when utilizing a wired communication port.

Referring now to FIG. 8, there is illustrated a more detailed block diagram of a system 800 of the embodiment of FIG. 6 when utilizing a wired communication port. The system 800 comprises a controller 801 (which may be a DSP (digital signal processor) where video processing is provided) for controlling all on-board operations, which includes processing input/output (I/O) data received into and transmitted from a discrete I/O interface 802. This includes receiving input from or sensing a change of status in the switches and controls (e.g., 110, 111, 113 and 120). A remote I/O block 804 interfaces to the controller 801 and facilitates connecting, for example, the remote switch 120 for convenient manipulation of the display parameters during use in the filed. The system 800 also includes a non-volatile memory 806 operatively connected to the controller 801 for storing the program instructions executed by the controller 801 on power up. The memory 806 can be a non-volatile memory such as EEPROM that can be updated as the user chooses to make changes to the settings depending on the type of hunt (i.e., animal or target shooting) and type of target (deer, elk, hog, etc). The system 800 also includes a RAM memory 807 for fast execution of instructions by the controller 801. The RAM memory 807 can also be used for temporary creation of variables during setup and operation of the system 100.

The system 800 also includes wired communications I/O circuitry 808 connected to the controller 801 for communicating data and/or instruction to and from external communication devices. The communications I/O 808 architecture includes, but is not limited to, RS-232, $I^2C$, USB, IEEE 1394, and other conventional communication architectures. The system 800 also includes the power supply 108 (remote and/or internal) for supplying power to all on-board components. The power supply 108 may include a regulator circuit for regulating the power to ensure stable voltage to all components requiring it. Thus if the power drops below a predetermined value, the controller 801 will perform an orderly shutdown so that the program stored in the memory 806 is not corrupted. The system 800 can also include an audio source 812 that produces an audio signal in response to predetermined events during setup, configuration, and operation of the system 100 of FIG. 1. The audio source 812 is optional, and can be disabled.

Figure 9A:
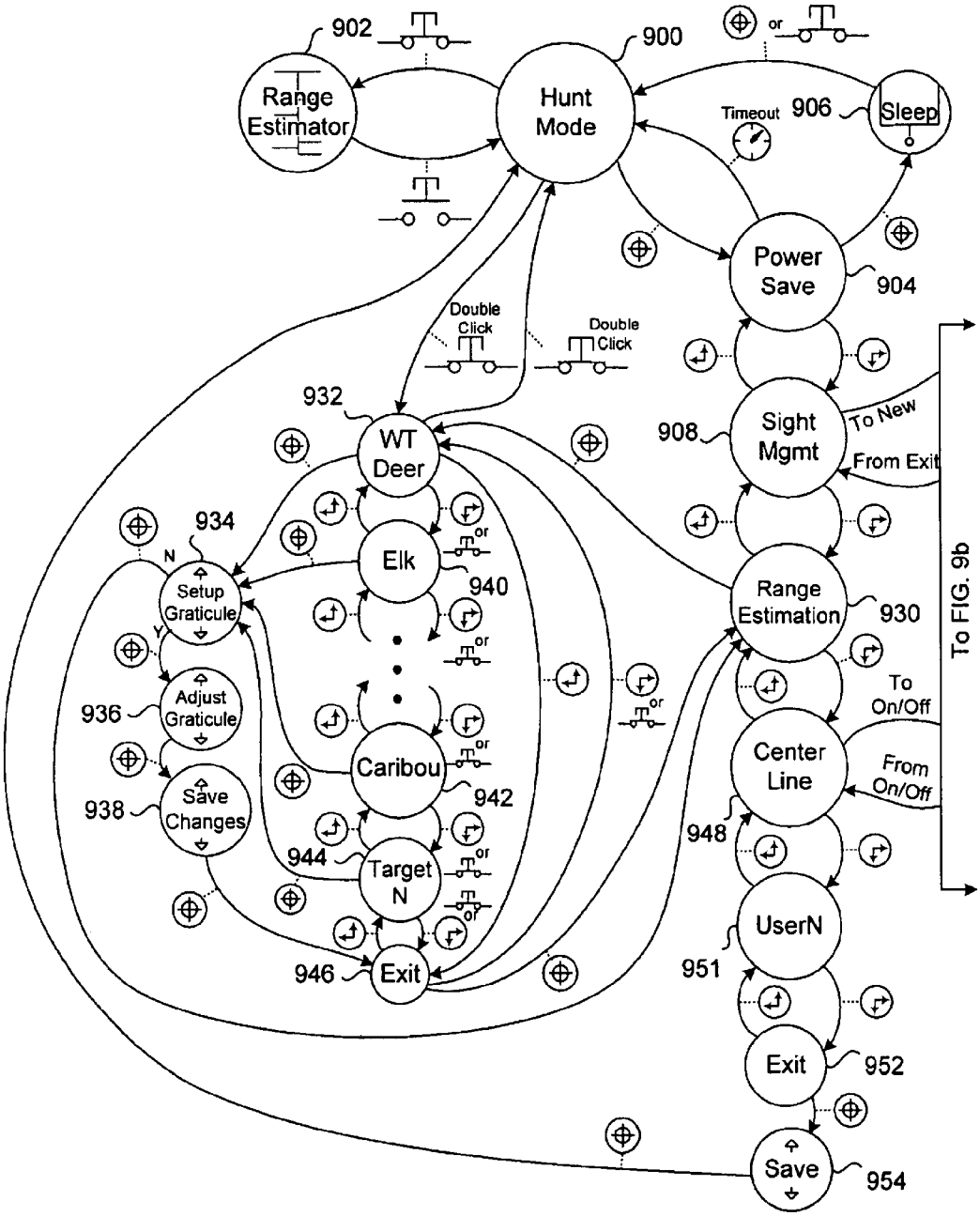
FIGS. 9*a* and 9*b* illustrate an exemplary state diagram of one mode of programming and operating the system.
Figure 9B:
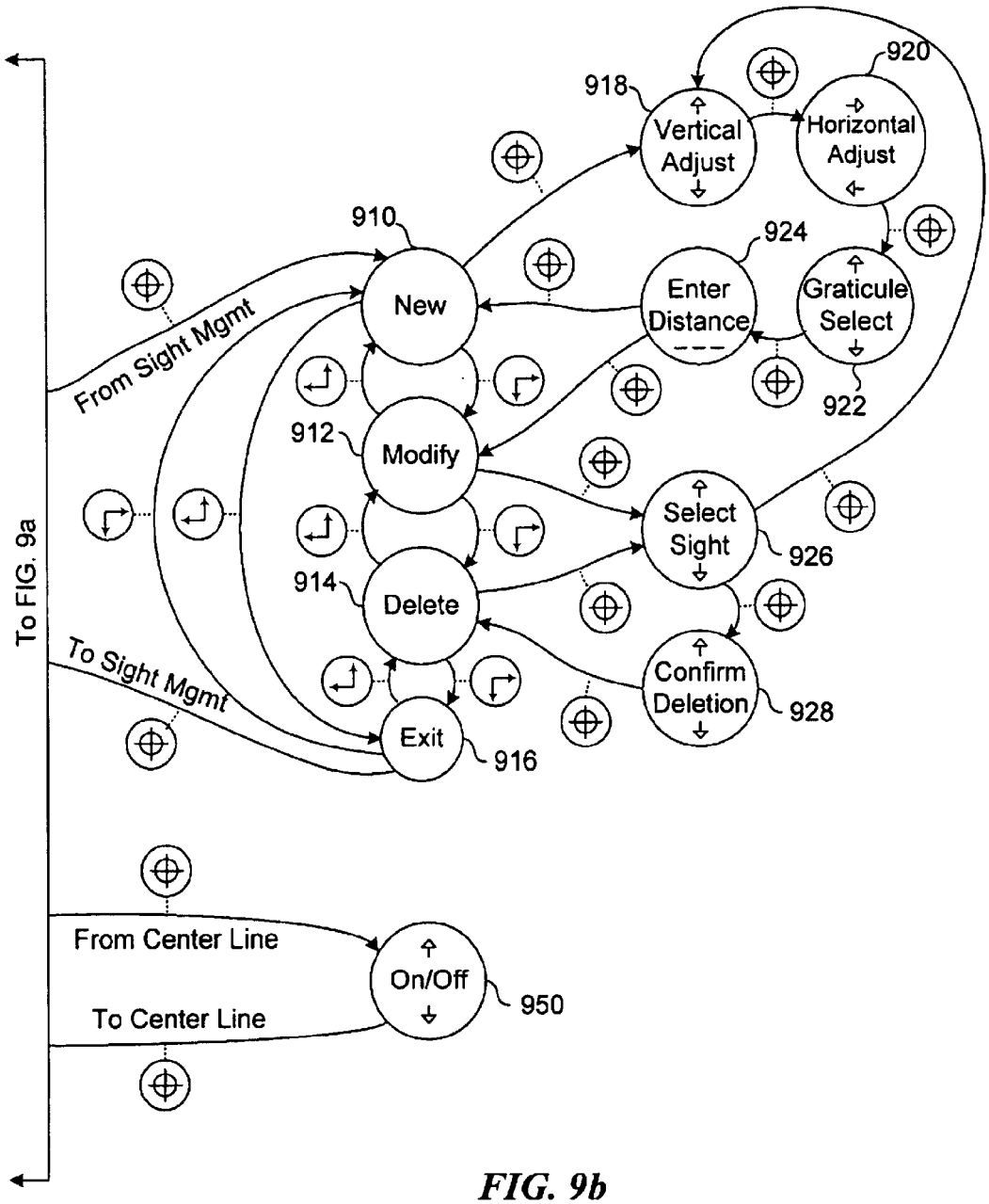

Referring now to FIGS. 9*a* and 9*b*, there is illustrated an exemplary state diagram of one mode of programming and operating the system 100. Beginning with FIG. 9*a*, when the user first applies power to the control circuitry 106 (or 800 and 1000) by closing the switch 110, the system 100 enters a hunt state 900. By pressing the momentary switch 120, flow is to a range estimator state 902. The user can then set the range to the target or the range to the location where the game is likely to pass. The user exits the range estimator state 902 by again pressing the momentary switch 120 (or releasing the momentary switch 120 from a depressed position). Note that the type of switch or signal used to move from state to state can be any switch or signal programmed to perform such a function.

Once back in the hunt state 900, the user can move to one of several other states. For example, the user can enter a power save state 904 to program power save parameters. Note that throughout discussion of the state diagram, various switch symbols for the three switches 111 are illustrated to indicate which of the three switches 111 is utilized to navigate the diagram and make selections. For example, a first of the three switches 111 represented by the crosshair symbol functions to select an option provided in the program. A second of the three switches 111 corresponding to right-angled left and up arrows is used to navigate back and up the program. A third of the three switches 111 corresponding to the right-angled down and to the right arrows is used to navigate further into the program and down the program menu.

Thus according to predetermined power save parameters programmed by the user, transition can flow to a sleep state 906. This transition can occur automatically when the system 100 is not being utilized, or the user can trigger the transition to sleep mode manually by selecting a switch. The transition can occur according to programmed instructions or selected by a switch to not occur at all when the user is in the field actively involved in the hunt. Accordingly, once out of sleep mode, program execution exits the sleep state 906 and transitions back to the hunt state 900. The transition from the sleep state 906 to the hunt state 900 can occur in accordance with the momentary switch 120 or the switches 111.

From the power save state 904, the user can menu through to a sight management state 908 where the user configures one or more of the sight configurations. In this particular embodiment, four states are illustrated in FIG. 9*b*: a new state 910 for beginning a new sight setup; a sight modification state 912 where the user can modify an existing sight configuration; a delete state 914 for deleting an existing sight configuration; and, an exit state 916 for exiting the states (910, 912, and 914) back to the sights state 908. From the new state 910, flow transitions to a vertical graticule setup state 918 for setting the vertical position of any number of the horizontal graticules. The user can then set the location of vertical hash marks for one or more of the horizontal graticules, as indicated in a horizontal adjust state 920. Flow continues to a graticule select state 922, where the user selects the type of graticule to use. Once completed, flow is to a distance state 924 where the user sets the distance between the horizontal graticules in effect defining the B2B distance of the particular game or target. From here, the user can transition back to either the new state 910, or to the modify state 912 by simply depressing one of the three switches 111. If the user moves back to the new state 910, transition to the modify state 912 is by depressing the third of the switches 111.

In the modify state 912, the user can modify or delete an existing sight configuration. To perform either, flow is to a select state 926 to select the sight configuration for modification or deletion. To modify, flow is back to the vertical adjust state 918 where the user can then adjust vertical, horizontal, graticules, and distance settings accordingly. If a sight configuration is to be deleted, flow is from the modify state 912 to the sight select state 926 to select the sight for deletion. Flow is then to a deletion confirmation state 928 where the user confirms deletion of the selected sight configuration. Flow then moves to the delete state 914 to delete the selected configuration. The user can then exit the sight management setup states via the exit state 916, which upon selection provides the user the options to go back to the sight management state 908, the delete state 914 and the new state 910. The user can move from the delete state 914 directly back to the sight select state 926 to select another configuration for modification or deletion. Note that the program allows the user to move bi-directionally between the new state 910 and the modify state 912, the modify state 912 and the delete state 914, the delete state 914 and the exit state 916 and, the new state 910 and the exit state 916.

After returning to the sight management state 908 from the exit state 916, the user can progress to a range estimation state 930. Range estimation is performed based upon a number of different types of targets, animal or non-animal. In this particular embodiment, flow moves to a white-tale deer state 932 to configure the B2B for a typical white tale deer, and the distance that is anticipated to the deer. In furtherance thereof, flow is to a graticule setup state 934. If the user desires to not setup the white tale deer graticule, program flow moves back to the range estimation state 930. On the other hand, if the user desires to setup the white tale deer graticule, program flow moves to an adjust graticule state 936 where the user adjusts the graticule. Once completed, flow moves to a save changes state 938 where the user can choose to save the settings previously configured for the white tale deer. Once saved, flow is to an exit state 946, and ultimately the range estimation state 930 for selecting another target for configuration. For example, there is provided an elk state 940 for setup and configuration of the sighting system 100 for the B2B of an elk. The elk state 940 also transitions to the graticule setup state 934, and subsequent setup states (936 and 938). Other animal states and/or non-animal target states can also be programmed for targeting, including, but not limited to, a caribou state 942. Any number of N targets (i.e., Target1, . . . , TargetN) can be associated with the target configurations via a target state 944. Once the target has been configured, flow is to the exit state 946 to exit back to the range estimation state 930. Note that the user can selectively move from target state to target state. For example, the program provides for bi-directional flow between the target states including the deer state 932 and the elk state 940, the elk state 940 and the subsequent target state, the last target state (i.e., caribou state 942) and the last target state 944, and the target state 944 and the exit state 946. The exit state 946 also has bi-directional flow with the first target state (i.e., the deer state 932).

Once all of the desired targets have been configured, flow is back to the range estimation state 930, and moves to a center line state 948 for turning the center line on or off. The center line state 948 is utilized for proper mounting the sight system 100 on the bow 200. If the user chooses to toggle the existing centerline state, flow is to a center line power state 950 to turn the center line on from an initial off state, or off from an initial on state. If the user chooses not to toggle the center line, flow moves to an a user state where a number of users N can be associated with a particular setup and configuration. Flow is then to an exit state 952 to exit the setup and configuration program. However, before exiting, flow is to a save state 954 to prompt the user to save the configuration data. Once saved, flow is back to the hunt mode state 900. The disclosed system 100 is operable to associate a specific user with a corresponding setup and configuration. Thus when a first user configuration is completed, a second user can configure the system 100 to his or her preferences. This facilitates quick use of the system 100 and bow 200 between a number of users who have programmed preferences into the system 100. The user-specific configurations are stored in the non-volatile memory and recalled by selecting the appropriate user setup after power-up.

Program flow is bi-directional between the power save state 904 and the sight management state 908, the sight management state 908 and the range estimation state 930, the range estimation state 930 and the center line state 948, the center line state 948 and the UserN state 951, and the UserN state 951 and the exit state 952.

Program flow is also bi-directional between the hunt mode 900 and the first target setup state (i.e., deer state 932).

Figure 10:
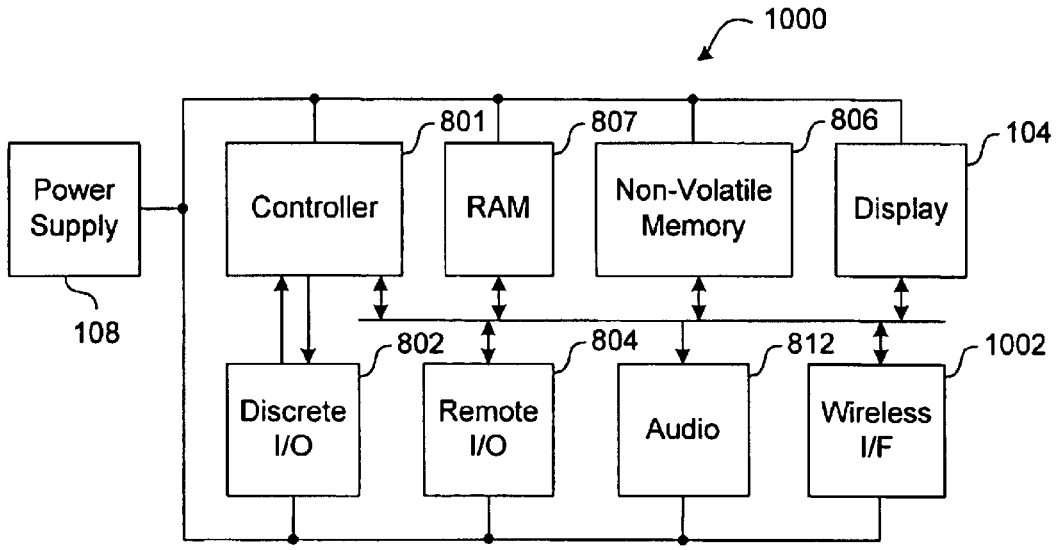
FIG. 10 illustrates a detailed block diagram of a system when utilizing a wireless communication port.

Referring now to FIG. 10, there is illustrated a detailed block diagram of a system 1000 when utilizing a wireless communication port. The system 1000 comprises the controller 801 for controlling all on-board operations, which includes processing input/output (I/O) data received into and transmitted from the discrete I/O interface 802. This includes receiving input from or sensing a change of status in the switches and controls (e.g., 110, 111, 113 and 120). A remote I/O block 804 interfaces to the controller 801 and facilitates connecting, for example, the remote switch 120 for convenient manipulation of the display parameters during use in the filed. The system 1000 also includes the non-volatile memory 806 operatively connected to the controller 801 for storing the program instructions executed by the controller 801 on power up. The memory 806 can be a non-volatile memory such as EEPROM that can be updated as the user chooses to make changes to the settings depending on the type of hunt (i.e., animal or target shooting) and type of target (deer, elk, hog, etc). The system 1000 also includes the RAM memory 807 for fast execution of instructions by the controller 801. The system 800 also includes the power supply 108 for supplying power to all on-board components. The power supply 108 may include a regulator circuit for regulating the power to ensure stable voltage to all components requiring it. Thus if the power drops below a predetermined value, the controller 801 will perform an orderly shutdown so that the program stored in the memory 806 is not corrupted. The system 1000 can also include an audio source 812 that produces an audio signal in response to predetermined events during setup and configuration of the system 100. The audio source 812 is optional, and can be disabled.

In this particular embodiment, the system 1000 now includes wireless communication capability (e.g., RF) via the wireless communication port 1002. This implementation facilitates the use of GPS (Global Positioning System) such that the hunter can now be located virtually anywhere he or she may hunting. In such an implementation, the capability to disable GPS may be included to conserve power of the power source 108. Of course, the hunter may engage an external power source to supplant the power needs of this more robust implementation. All that is required is a cable sufficiently long to extend from the supplemental power source that is carried on the hunter to the system 100 mounted on the bow 200. The cable can be routed to minimize entanglement while operating the bow 200 and system 100.

Figure 11:
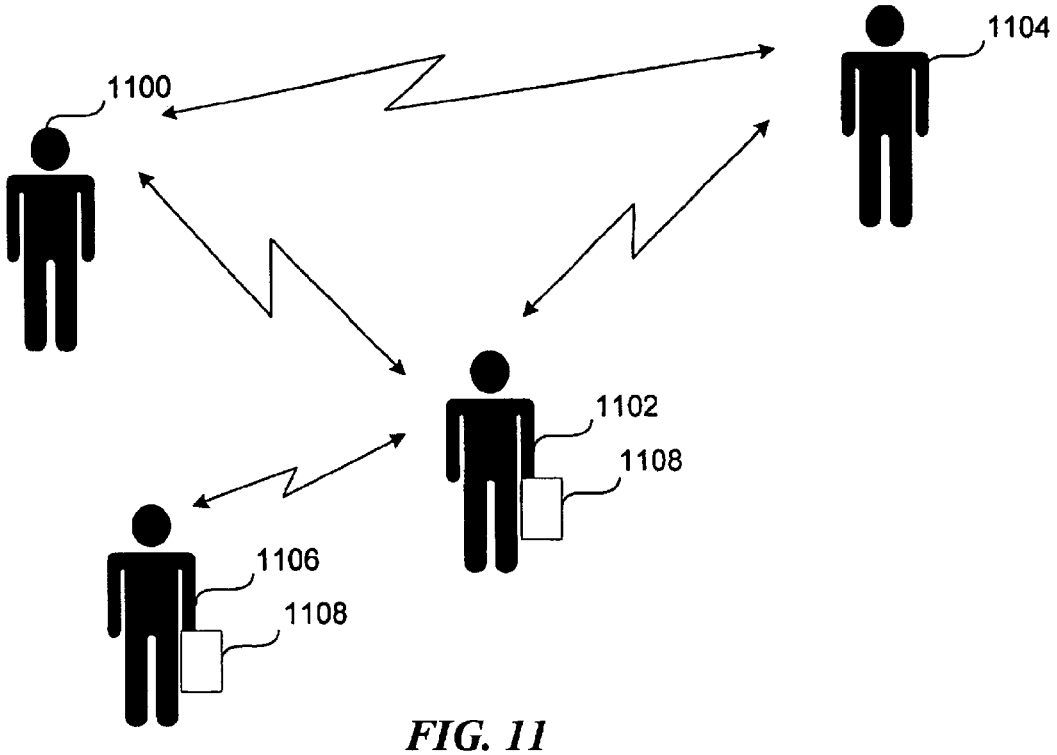
FIG. 11 illustrates a hunting network where a plurality of hunters can view another hunter's perspective through the HUD display.

Referring now to FIG. 11, there is illustrated a hunting network where a plurality of hunters can view another hunter's perspective through the HUD display. Utilizing the wireless application of FIG. 10, it now becomes possible to implement peer-to-peer wireless communication between any number of hunters in the field. Utilizing suitable wireless communication architecture such as Bluetooth®, each hunter can perceive what another hunter may be viewing through the HUD. Thus a first hunter 1102 in a blind waiting for the target game to pass by, can switch to view the HUD of a second hunter 1102 to view what activity the second hunter 1102 may be seeing. Similarly, a third hunter 1104 in operative wireless communication with either the first or second hunter, can switch to either of them to view what the respective HUD of the hunter is showing. This becomes a wireless network hunting arrangement among these three hunters (1100, 1102, and 1103). Of course, the range of communication may be limited by the particular wireless communication utilized.

Wireless communication also facilitates recording on a recording device 1106 at a remote location 1108 what the hunter may see via the HUD. Alternatively, the hunter can carry the recording device 1106 attached to his or her belt or clothing such that the recording device 1108 is wired to the bow system 100 to receive video signals or images for storing, and later playback.

Figure 12:
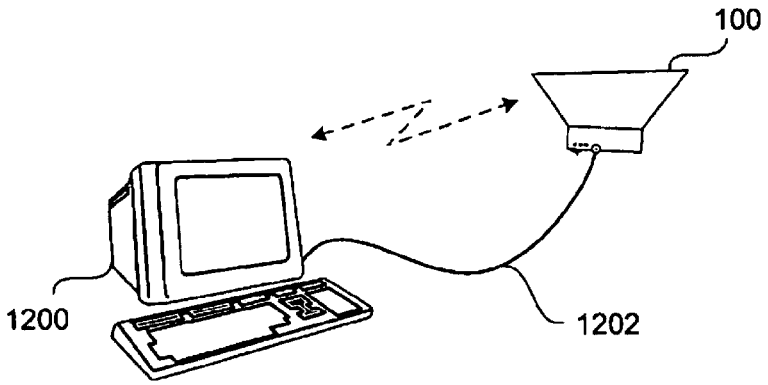
FIG. 12 illustrates a software interface that can be utilized to easily setup and configure portions of the system via a personal computer.

Referring now to FIG. 12, there is illustrated a software interface that can be utilized to easily setup and configure portions of the system 100 via a personal computer. Since the bow system 100 includes a communication interface, the system 100 can be connected to a personal computer 1200 via a cable 1202 or wirelessly via the wireless system 1000 of FIG. 10, which computer 1200 runs a user interface for programming the bow system 100 therefrom. Thus the hunter does not need to program most of the setup for the sighting system while in the field or at the target range. Preliminary setup and configuration can be performed at home or via a portable computer at the hunting location. In furtherance thereof, the program of stored in the firmware of the system 100 is then converted for use via the user interface software of the computer 1200.

Although the preferred embodiment has been described in detail, it should be understood that various changes, substitutions and alterations could be made therein without departing from the spirit and scope of the invention as defined by the appended claims.

What is claimed is:

1. A bow sighting system of a bow, comprising:

a housing mounted on the bow;

an electronically programmable subsystem protected by the housing, the subsystem executes at least one instruction stored therein and stores multiple configurations; and a liquid crystal display in communication with the programmable subsystem that facilitates the presentation of visual data in the form of a heads-up display (HUD) of graphical and alphanumeric text to a user of the bow according to programmed instructions.

2. The system of claim 1, wherein the subsystem includes a controller that executes the at least one instruction.

3. The system of claim 1, wherein the visual data of the display is presented to the user by reflection from a viewing window seated in the housing, the reflected visual data generates the heads-up display through which the user views a target.

4. The system of claim 1, wherein the subsystem includes a wired communications port that communicates data and signals.

5. The system of claim 1, wherein the subsystem includes a wireless communications port that communicates data and signals wirelessly.

6. The system of claim 1, wherein the subsystem includes a memory that stores the at least one instruction.

7. The system of claim 6, wherein the memory is one of a non-volatile memory and a random access memory.

8. The system of claim 1, wherein the subsystem includes at least one status indicator that indicates a status to the user of the system.

9. The system of claim 1, wherein the subsystem includes at least one status indicator that indicates a status to the user of the system, the at least one status indicator including at least one of an audio source and a light source.

10. The system of claim 1, wherein the subsystem includes at least one LED that indicates a status to the user of the bow, the LED operated according to the at least one instruction.

11. The system of claim 1, wherein the subsystem includes a switch operatively connected to facilitate programming the subsystem.

12. The system of claim 1, wherein the subsystem includes a power source that provides power to the subsystem.

13. The system of claim 1, wherein the subsystem is programmable to include sight settings for at least one of animal targets and non-animal targets.

14. The system of claim 1, wherein the subsystem is programmable to include sight settings for at least one user of the system.

15. The system of claim 1, wherein the programmable subsystem processes programming instructions associated with at least one of a power save mode, range estimation, center line adjustment, horizontal and vertical graticule adjustment, artifact presentation, display colors, sight configuration modification, sight configuration deletion, and a distance parameter.

16. The system of claim 1 communicates with a personal computer for programming of the subsystem by the user via a graphical user interface of the personal computer.

17. The system of claim 16, wherein the communication is one of wired and wireless.

18. The system of claim 1, wherein the subsystem processes a global positioning signal.

19. The system of claim 1, wherein the subsystem is programmed to store and execute at least one of a single user configuration for the user, multiple configurations for the user, and multiple configurations for multiple respective users.

20. The system of claim 1, wherein the subsystem is programmed to automatically skew HUD data in response to orientation of the subsystem.

21. The system of claim 1, wherein the subsystem presents range estimator display data in response to the user selecting a switch, the switch is at least one of local to the housing and remote from the housing.

22. A method of providing bow sighting system of a bow, comprising:

mounting a housing on the bow;

enclosing an electronically programmable subsystem within the housing, the subsystem executes at least one instruction stored therein, and stores multiple user configurations; and providing an LCD in communication with the programmable subsystem for displaying data via a HUD, the data includes at least two of graticules, alphanumeric text, skewed data, and graphic artifacts.

23. The method of claim 22, wherein the subsystem further comprises a controller that executes the at least one instruction.

24. The method of claim 22, wherein the subsystem includes at least one of a display for presenting the visual data to a user of the bow according to programmed instructions, a power source for providing power, and one or more status indicators for indicating a status of the subsystem.

25. The method of claim 24, wherein the visual data of the display is presented to the user by reflection from a viewing window seated in the housing, the reflected visual data generating the HUD through which the user views a target.

26. The method of claim 22, wherein the subsystem includes at least one of a wired communications port and a wireless communication port, for communicating data and signals.

27. The method of claim 22, wherein the subsystem includes a non-volatile memory that stores the at least one instruction.

28. The method of claim 22, wherein the subsystem includes at least one status indicator that indicates a status to a user of the system, the at least one status indicator including at least one of an audio source and a light source.

29. The method of claim 22, wherein the subsystem includes a switch operatively connected to facilitate programming the subsystem.

30. The method of claim 22, wherein the subsystem is programmable to include sight settings for at least one of animal targets and non-animal targets, and for at least one user of the system.

31. The method of claim 22, wherein the programmable subsystem processes instructions associated with at least one of a power save mode, range estimation, center line adjustment, horizontal and vertical graticule adjustment, artifact presentation, display colors, sight configuration modification, sight configuration deletion, and a distance parameter.

32. The method of claim 22, wherein the subsystem communicates one of wired and wirelessly with a personal computer for programming thereof by a user via a graphical user interface of the personal computer.

33. The method of claim 22, wherein the subsystem at least one of wirelessly transmits data and signals to a remote source and wirelessly receives data and signals from the remote source.

34. The method of claim 22, wherein the subsystem comprises one or more inputs for at least one of adjustment of display brightness, powering the system on and off, enabling a power-saving feature, system configuration, setup, and testing.

35. The method of claim 22, wherein the subsystem includes a power connection that receives power from at least one of an internal battery and an external battery unit that interfaces to the subsystem.

36. The method of claim 22, wherein the subsystem is programmed to store and execute at least one of a single user configuration for a user, multiple configurations for a user, and multiple configurations for multiple respective users.

37. The method of claim 22, wherein the subsystem is programmed to automatically skew HUD data in response to orientation of the subsystem.

38. The method of claim 22, wherein the subsystem presents range estimator display data in response to a user selecting a switch, the switch is at least one of local to the housing and remote from the housing.

39. A sighting system for a bow, comprising:

means for mounting the system on the bow;

means for electronically programming and storing in the system a plurality of user configurations;

means for displaying data to the user as a HUD; and means for communicating with the system.

* * * * *

UNITED STATES PATENT AND TRADEMARK OFFICE

CERTIFICATE OF CORRECTION

PATENT NO. : 6,952,881 B2
DATED : October 11, 2005
INVENTOR(S) : Joseph F. McGivern It is certified that error appears in the above-identified patent and that said Letters Patent is hereby corrected as shown below:

Column 2,
Line 66, "while a night" should be -- while at night --.

Column 3,
Line 8, "allows the use" should be -- allows the user --.
Line 58, "sight system 100" should be -- sighting system 100 --.

Column 4,
Line 14, "crossbow normally" should be -- crossbow is normally --.

Column 9,
Line 29, "options arc to be" should be -- options are to be --.

Column 10,
Line 12, "the filed" should be -- the field --.

Column 13,
Line 8, "use in the filed" should be -- use in the field --.

Signed and Sealed this

Fourteenth Day of February, 2006

JON W. DUDAS
*Director of the United States Patent and Trademark Office*